US007570544B2

(12) United States Patent
Kalbhenn et al.

(10) Patent No.: US 7,570,544 B2
(45) Date of Patent: Aug. 4, 2009

(54) DIAPHRAGM CUP FOR AN ULTRASONIC TRANSDUCER

(75) Inventors: Micha Kalbhenn, Ludwigsburg (DE); Peter Rapps, Karlsruhe (DE); Oliver Hartig, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/630,484

(22) PCT Filed: May 3, 2005

(86) PCT No.: PCT/EP2005/052008

§ 371 (c)(1),
(2), (4) Date: Aug. 20, 2007

(87) PCT Pub. No.: WO2006/000494

PCT Pub. Date: Jan. 5, 2006

(65) Prior Publication Data

US 2008/0130416 A1 Jun. 5, 2008

(30) Foreign Application Priority Data

Jun. 29, 2004 (DE) ..... 10 2004 031 310

(51) Int. Cl.
*G10K 9/122* (2006.01)

(52) U.S. Cl. ..... 367/174

(58) Field of Classification Search ..... 367/174
See application file for complete search history.

(56) References Cited

U.S. PATENT DOCUMENTS

| | | | | |
|---|---|---|---|---|
| 3,278,409 | A * | 10/1966 | Barringer et al. | 204/198 |
| 3,638,052 | A | 1/1972 | Massa et al. | |
| 4,388,160 | A * | 6/1983 | Rynne | 205/176 |
| 7,161,280 | B2 * | 1/2007 | Brun | 310/334 |
| 2005/0061084 | A1 * | 3/2005 | Brun | 73/861.18 |
| 2008/0130416 | A1 * | 6/2008 | Kalbhenn et al. | 367/174 |

FOREIGN PATENT DOCUMENTS

| | | |
|---|---|---|
| EP | 0 802 521 | 10/1997 |
| JP | 10-70784 | 3/1989 |
| JP | 1282997 | 11/1989 |
| JP | 3-024625 | 2/1991 |
| JP | 2000233006 | 8/2000 |
| JP | 2003275684 | 9/2003 |
| JP | 2005502437 | 1/2005 |
| WO | WO 03/024625 | 3/2003 |
| WO | 03 045586 | 6/2003 |
| WO | WO 2006000494 A1 * | 1/2006 |

OTHER PUBLICATIONS

E.F. Wondris, *Surface Coating,* Encyclopedia Britannica, found on the internet, Sep. 13, 2005. paragraphs 0001, 0006.
Wondris E.F. "Treating of Steel Surface Coating" Encyclopedia Britannica, Online 2005, XP002344583.

* cited by examiner

*Primary Examiner*—Dan Pihulic
(74) *Attorney, Agent, or Firm*—Kenyon & Kenyon LLP

(57) ABSTRACT

Provided is a diaphragm cup for an ultrasonic transducer having a hollow area for carrying a diaphragm, which is electroplated, preferably with a chrome coating.

6 Claims, 1 Drawing Sheet

DIAPHRAGM CUP FOR AN ULTRASONIC TRANSDUCER

FIELD OF THE INVENTION

The present invention is directed to a diaphragm cup for an ultrasonic transducer.

BACKGROUND INFORMATION

Ultrasonic sensors which are used for distance measurement between vehicles and obstructions are already known. The sensors have an oscillating diaphragm, which is generally excited to oscillate in resonance via a piezoelement. The sound signal produced in this way is emitted by the diaphragm of the ultrasonic sensor, reflected by an obstruction, and received again by the same or a neighboring ultrasonic sensor. The distance of the sensor to the obstruction is able to be determined from the runtime. In general, the piezoelement is positioned on the floor of a diaphragm cup, which is mounted in the bumper of the vehicle, for example, the piezoelement being connected to analysis electronics in such a way that the entire device forms the corresponding ultrasonic sensor. In order that the sound produced by the piezoelement may be emitted and/or also received appropriately, the diaphragm cups are shaped in such a way that they have a natural resonance in the range of the ultrasound waves used. The resonance is determined in this case by the dimensions and the oscillation characteristics of the diaphragm cup, in particular by the layer thickness of the diaphragm.

Preferably, a metal, in particular aluminum, or a ceramic material is used as the material for the diaphragm cups. So that the sensors are not unnecessarily noticeable in the vehicle contour and that the sensors may be protected from environmental influences, it is necessary to provide the sensors with appropriate coatings and/or lacquerings. However, depending on the material, these layers may not be applied directly to the diaphragm cup. Multiple materials either do not adhere sufficiently or influence the sound propagation of the ultrasonic waves negatively. Depending on the layer thickness, the application may also result in the resonance frequency of the diaphragm cup as a whole being changed, so that the diaphragm may no longer be excited in resonance to oscillate.

SUMMARY OF THE INVENTION

In contrast, a diaphragm cup according to the present invention has the advantage that the diaphragm is provided with electroplating at least on the outside of the diaphragm cup.

Electroplating has the advantage that it bonds permanently to the base material of the diaphragm cup and, in addition, is applied with a uniform thickness. In this way, inhomogeneities and therefore interference with the oscillation behavior of the diaphragm may be prevented. If necessary, thinner, more uniform coatings may thus be applied than in the case of lacquering.

It is particularly advantageous for a chrome layer, in particular a microporous chrome layer, to be applied to the diaphragm cup. A chrome layer of this type offers a good visual appearance of the sensor and may have its color tailored if necessary.

Furthermore, it is advantageous to apply an intermediate coating before the chrome coating, which increases the corrosion resistance of the chrome layer. Layers which contain copper and/or nickel, and which are preferably also applied via electroplating are preferably applied for this purpose. In this way, an electrochemical separation between the aluminum and the chrome may be achieved.

Furthermore, it is advantageous to change the resonance frequency of the uncoated diaphragm cup in such a way that the coated diaphragm cup first has the desired resonance frequency. Because of this, a coated diaphragm cup has the same performance in the desired frequency range as a currently typical, uncoated diaphragm cup.

Furthermore, it is advantageous to design the walls of the diaphragm cup, which form a hollow area of the diaphragm cup, with a variable thickness so that the thicker wall areas form a diaphragm area which thus outputs the ultrasonic signal in a desired directional area.

DETAILED DESCRIPTION

The diaphragm cup according to the present invention may be used for any application. In particular, use in a motor vehicle is advantageous, since high corrosion resistance in relation to weather influences, and also, for example, road salt, must be provided, while an acceptable appearance of the sensor is also necessary. The present invention is therefore explained in the following for a diaphragm cup for use in an ultrasonic distance system for a motor vehicle.

Figure 1:
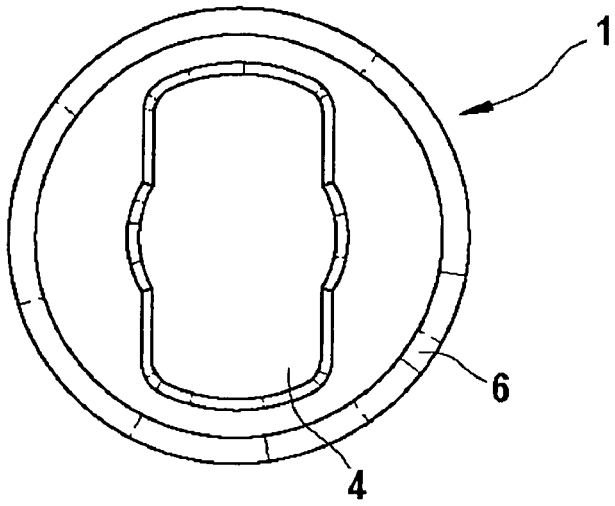
FIG. 1 shows a top view from an open side of a diaphragm cup according to the present invention.
Figure 2:
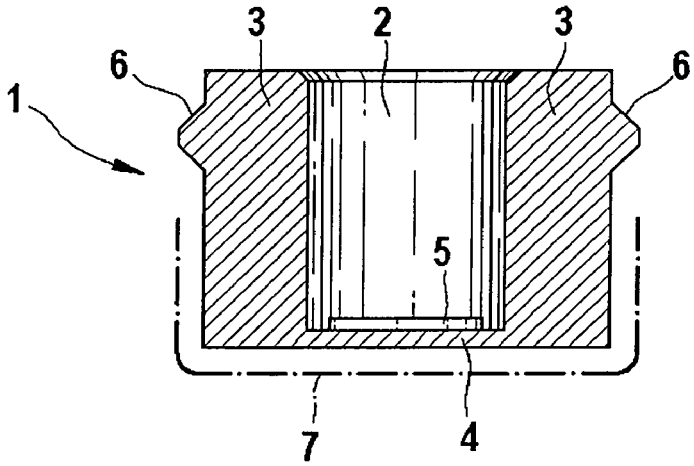
FIG. 2 shows a cross section of a diaphragm cup according to the present invention.
Figure 3:
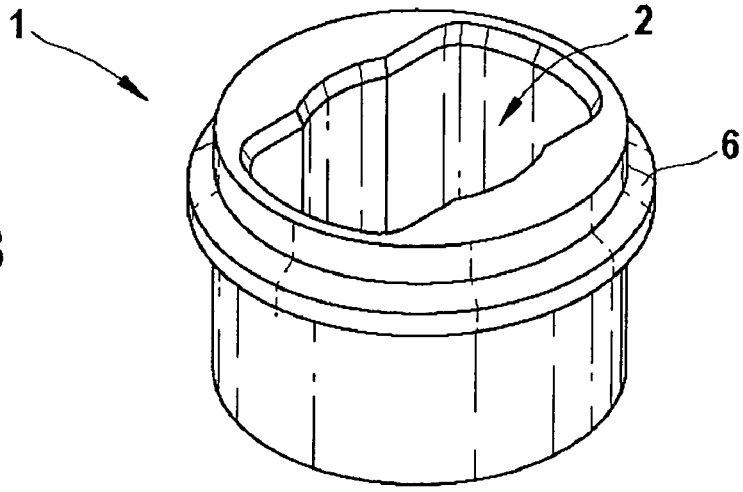
FIG. 3 shows a perspective illustration of a diaphragm cup according to the present invention.

In FIG. 2, a cross section of diaphragm cup 1 is illustrated, a hollow area 2 being enclosed by walls 3 of the diaphragm cup. The diaphragm cup is delimited on one side by diaphragm 4, on whose inside, which faces hollow area 2, a piezoelement 5, which is only indicated here and is connected to analysis electronics, which are not shown in the drawing, is placed for the transmission and reception procedure of the ultrasonic signal. The end of hollow area 2 of diaphragm cup 1 diametrically opposite diaphragm 4 is open, so that the electrical supply lines and/or the analysis electronics may be introduced into the diaphragm cup here. Diaphragm 4 is designed to be significantly thinner than walls 3 of the diaphragm cup, so that the sound generated by the piezoelement is relayed only relatively weakly to walls 3 of the diaphragm cup as much as possible. In this way, sound relaying, which may interfere with other sensors, is to be prevented. For holding in a suitable installation unit, walls 3 of diaphragm cup 1 are provided with a peripheral groove 6, via which diaphragm cup 1 may be inserted into a suitable holding unit. As may be seen from FIG. 1, diaphragm surface 4 is not circular, like the external contour of the diaphragm cup, but rather has a nearly rectangular basic structure. Piezoelement 5 is not shown in FIG. 1 and is preferably positioned centrally on diaphragm 4. A coating 7 of the diaphragm cup is indicated in FIG. 2 by a dashed line.

In a preferred embodiment, diaphragm cup 1 is made of aluminum. First, a copper layer with a thickness of at least 15 μm is applied to the aluminum via electroplating. A glossy nickel layer having a thickness of approximately 10 μm and subsequently a semiglossy nickel layer having a thickness of 30 μm are applied thereon. These intermediate layers, which are used for corrosion resistance, are finally covered with a chrome coating that is preferably designed to be microporous. The thickness of the chrome coating is preferably 0.25 μm. Since the coating is performed via electroplating, this coating is performed before further assembly of the sensor, in particular before attachment of the piezoelement.

Because of the rigidity of the deposited materials, a frequency shift of the coated diaphragm cup in relation to the uncoated diaphragm cup with respect to higher resonance frequencies is achieved in the case of a coating of this type. The coated diaphragm cup therefore no longer has its original resonance frequency, which is 56 kHz in one embodiment, for example. So that the coated diaphragm cup also has a resonance of the desired frequency, the layer thickness of the diaphragm is reduced in such a way that the resonance of the uncoated diaphragm cup is reduced in this case from 56 kHz to approximately 52 kHz. In this way, the entire system, i.e., the coated diaphragm cup, again reaches the setpoint frequency of 56 kHz. The chromed sensor thus has the desired performance in the entire frequency range.

While the diaphragm cup preferably has a diameter of 15 mm, the diaphragm cup has a height of approximately 10 mm. The diaphragm thickness is selected in a range from 0.61 mm to 0.63 mm. For this purpose, the diaphragm thickness is reduced by approximately 1 mm in relation to an uncoated sensor.

What is claimed is:

1. A diaphragm cup for an ultrasonic transducer, comprising:

a wall for carrying a diaphragm capable of being excited to oscillate; and electroplating provided at least in an area of the diaphragm at least on an outside of the diaphragm cup;

wherein the wall encloses a hollow area, the hollow area having a top and a bottom, the top of the hollow area being near a top area of the diaphragm cup, the bottom of the hollow area being near a bottom area of the diaphragm cup, and wherein the top area of the diaphragm cup includes an opening, and the bottom area of the diaphragm cup includes the diaphragm.

2. The diaphragm cup as recited in claim 1, wherein the electroplating includes at least one chrome layer.

3. The diaphragm cup as recited in claim 2, wherein:

the electroplating includes at least one of a copper layer, a glossy nickel layer, and a semiglossy nickel layer to carry a chrome layer.

4. The diaphragm cup as recited in claim 3, further comprising:

a lacquer layer situated on the chrome layer.

5. The diaphragm cup as recited in claim 1, wherein:

a thickness of the diaphragm is such that the diaphragm cup has a predefined resonance frequency after application of the electroplating.

6. The diaphragm cup as recited in claim 1, wherein:

the wall has a variable thickness.

* * * * *